United States Patent [19]

Beneke et al.

[11] 4,379,357

[45] Apr. 12, 1983

[54] METHOD AND APPARATUS FOR SEPARATING WASTE FROM A FIBER-AND-WASTE MIXTURE

[75] Inventors: Wolfgang Beneke; Walter Jager, both of Monchen-Gladbach, Fed. Rep. of Germany

[73] Assignee: Trutzschlar GmbH & Co. KG, Monchen-Gladbach, Fed. Rep. of Germany

[21] Appl. No.: 174,103

[22] Filed: Jul. 31, 1980

[30] Foreign Application Priority Data

Aug. 4, 1979 [DE] Fed. Rep. of Germany ..... 2931699

[51] Int. Cl.[3] ..... D01G 15/80

[52] U.S. Cl. ..... 19/105; 19/107; 19/109

[58] Field of Search ..... 209/145, 148; 19/98, 19/99, 105, 107, 109

[56] References Cited

U.S. PATENT DOCUMENTS

| | | | |
|---|---|---|---|
| 1,023,750 | 4/1912 | Morscher | 209/145 |
| 2,700,190 | 1/1955 | Rowe | 19/109 |
| 4,064,598 | 12/1977 | Katoh et al. | 19/107 X |
| 4,271,564 | 6/1981 | Estebanell | 19/107 X |

FOREIGN PATENT DOCUMENTS

| | | | |
|---|---|---|---|
| 23597 | 2/1981 | European Pat. Off. | 19/107 |
| 2743187 | 3/1978 | Fed. Rep. of Germany | 19/107 |
| 438159 | 5/1912 | France . | |
| 635567 | 3/1928 | France . | |
| 41-14616 | 8/1966 | Japan | 19/107 |
| 395812 | 1/1966 | Switzerland . | |
| 942540 | 11/1963 | United Kingdom . | |

*Primary Examiner*—Louis Rimrodt

*Attorney, Agent, or Firm*—Spencer & Kaye

[57] ABSTRACT

For separating waste from a fiber-and-waste mixture in a textile machine, the mixture is tangentially thrown from a rotating roll by centrifugal force. An air flow is directed onto the traveling particles of the mixture such that fibers are returned to the roll, while the waste particles are allowed to continue their travel. Subsequently, the waste particles are removed by suction.

9 Claims, 3 Drawing Figures

METHOD AND APPARATUS FOR SEPARATING WASTE FROM A FIBER-AND-WASTE MIXTURE

BACKGROUND OF THE INVENTION

This invention relates to a method and an apparatus for separating waste from a fiber-and-waste mixture which is thrown tangentially by a rotating roll of a textile machine.

In equipment which prepares for a spinning process, particularly openers, cleaners and cards, as well as in the subsequent further processing steps, waste and the like have to be separated and removed from the fibers. This is conventionally effected by rotary rolls in cooperation with screens or the like. Often, however, a substantial part of the fibers is lost by being eliminated with the waste. This undesirable result is due, among others, to uncontrolled air flows.

SUMMARY OF THE INVENTION

It is an object of the invention to provide an improved method and apparatus of the above-outlined type which ensures that as little fiber as possible is eliminated with the waste so that the fiber loss is reduced to a very substantial degree.

This object and others to become apparent as the specification progresses, are accomplished by the invention, according to which, briefly stated, the fiber-and-waste mixture is exposed to an air stream in such a manner that there is effected a separation of the fibers from the waste and thereafter the fibers are returned to the roll, while the waste is removed by vacuum.

The invention is based on the principle of using the unlike mass of the waste particles on the one hand and fibers on the other hand for the separation of the two components. By exposing the fiber-and-waste mixture to an air stream, the significantly lighter fibers are blown out of the mixture and preferably returned to the rotating roll. The waste which still may contain some fibers is subsequently removed by vacuum. Due to their larger mass, the waste particles have a higher kinetic energy than the fibers so that the waste particles, for example, in an oppositely oriented fluid flow, have a significantly greater braking path than the braking path of the fibers whose mass is smaller. The method according to the invention utilizes this phenomenon to provide for a secure separation of the waste particles from the fibers.

The method according to the invention finds application particularly in connection with rotating clothed rolls such as cleaning rolls with beater lugs, lickerins, carding cylinders, etc, which entrain the waste particles and fibers in the direction of rotation. Such an entrainment is ensured by providing external screens for the rolls. In case one or more openings are provided in the screens, the waste particles and fibers tend to exit through such openings tangentially at a predetermined angle.

As the momentarily exposed surface portions of the rotating roll re-enter underneath the screen, at the entrance slot there is obtained a pressure reduction (vacuum). This suction force is compensated by the air stream necessary to effect the above-noted braking of the fiber and the waste particles.

In case of the usual sizes and shapes of fibers and waste particles, for predetermined velocities the braking path $x_{crit\,p}$ (braking path for the waste particle) and $x_{crit\,f}$ (braking path for the fiber) may be computed according to the following relationships:

$$x_{crit} = \frac{2}{\rho} \cdot \frac{m}{F} \cdot \frac{1}{c_w} \cdot N_{crit}$$

wherein $x_{crit}$ is the braking path (that is, the length of the traveled path, at the end of which the particle reverses its direction of travel);

$\rho$ is the density;

m is the mass;

$c_w$ is the resistance coefficient;

F is the surface area;

$N_{crit}$ is a coefficient obtained by the formula $$N_{crit} = \ln \frac{W_o + v}{v} \Bigg| - \Bigg| \frac{W_o}{W_o + v}$$

wherein $W_o$ is the initial velocity of the particle and v is the fluid velocity.

Given the usual geometry of the waste particles and fibers, computation shows that the braking path of the waste particles have the following ratio to the braking path of the fibers:

$$\frac{x_{crit\,p}}{x_{crit\,f}} = \frac{10 \text{ to } 20}{1}$$

The above relationship means that in a countercurrent a waste particle is capable of traveling approximately 10 to 20 times as far as a fiber; consequently, in this manner there can be achieved an effective separation of the waste particles from the fibers.

Expediently, the air stream is in counterflow with respect to the fiber-and-waste mixture. Preferably, the air stream is directed towards the rotating roll at an inclination or even perpendicularly to the mixture, so that the air stream may return the fibers to the roll.

According to a preferred embodiment of the apparatus of the invention for performing the above-outlined method, in the direction of the centrifugal force affecting the fiber-and-waste mixture, a braking channel is provided which leads to a waste collecting chamber connected to a vacuum apparatus. Further, a pressurized air channel is provided which communicates with a pressure source and the outlet of which merges into the braking channel.

Preferably, the width of the braking channel is adjustable for the purpose of metering the braking air stream. Expediently, the braking channel can be arrested in the adjusted position.

Preferably, the length of the braking channel is also adjustable. In this manner the braking path can be altered so that the size of the waste particle still to be admitted for the separation can be determined. According to a further feature of the invention, the orientation of the pressurized air channel is adjustable.

DESCRIPTION OF THE PREFERRED EMBODIMENTS

Figure 1:
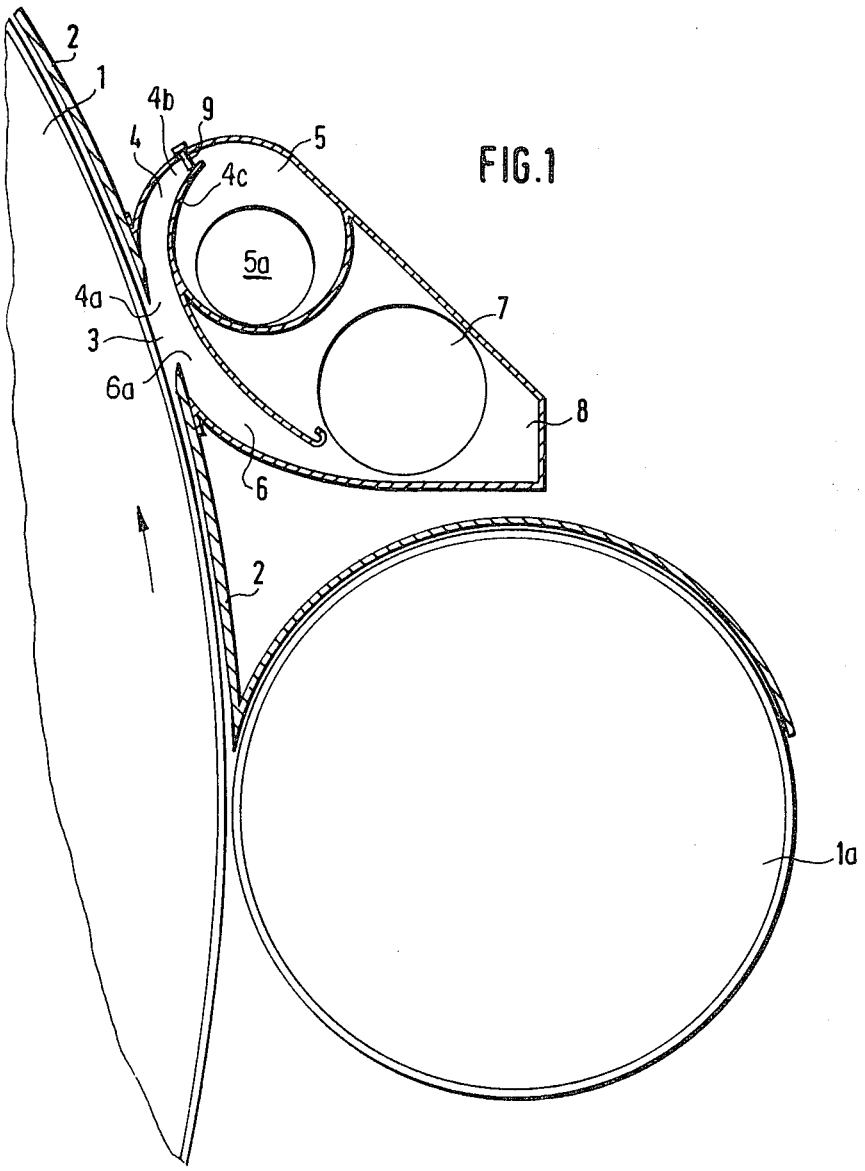
FIG. 1 is a schematic side elevational view of a preferred embodiment of the invention.

Turning now to FIG. 1, there is shown a cylinder 1 and a lickerin 1*a* of a carding machine not illustrated in further detail. The cylinder 1 rotates counterclockwise as indicated by the arrow. With the cylinder 1 there is associated a screen 2 provided with an opening 3. The fiber-and-waste mixture entrained by the cylinder 1 exits through the opening 3, in the direction of the centrifugal force, into a braking channel 4. The latter leads into a waste collecting chamber 5 which is coupled to a vacuum device (not illustrated) by means of a conduit 5*a*. In the rearward (upstream) extension of the braking channel 4 there is provided a pressurized air channel 6 which is situated adjacent that portion of the screen 2 that extends below the opening 3. The pressurized air channel 6 is in communication with a pressurized air chamber 8 by means of a pressure conduit 7. The outlet 6*a* of the pressurized air channel 6 is oriented towards the inlet 4*a* of the braking channel 4. At the outlet end 4*b* of the braking channel 4 there is provided an adjusting element 9 by means of which the width of the braking channel 4 can be altered. More particularly, the adjusting device 9 which can preferably be immobilized in any set position, may be a setscrew whose end engages a flexible wall component 4*c* defining, for example, one side of the braking channel 4.

In operation, the fiber-and-waste mixture entrained by the cylinder 1 separates therefrom in a first zone (zone of separation) and exits through the opening 3 provided in the screen 2 to thus enter into the braking channel 4. An air stream exiting at 6*a* from the pressurized air channel 6 impinges at an oblique angle on the flying fiber-and-waste mixture in a second zone (zone of impingement) which is downstream of the first zone as viewed in the direction of travel of the mixture. The pressurized air blows the fibers back to the cylinder 1, while the waste particles, by virtue of their greater masses, continue their travel in the braking channel 4 and are removed from the waste collecting chamber 5 by a suction device.

Figure 2:
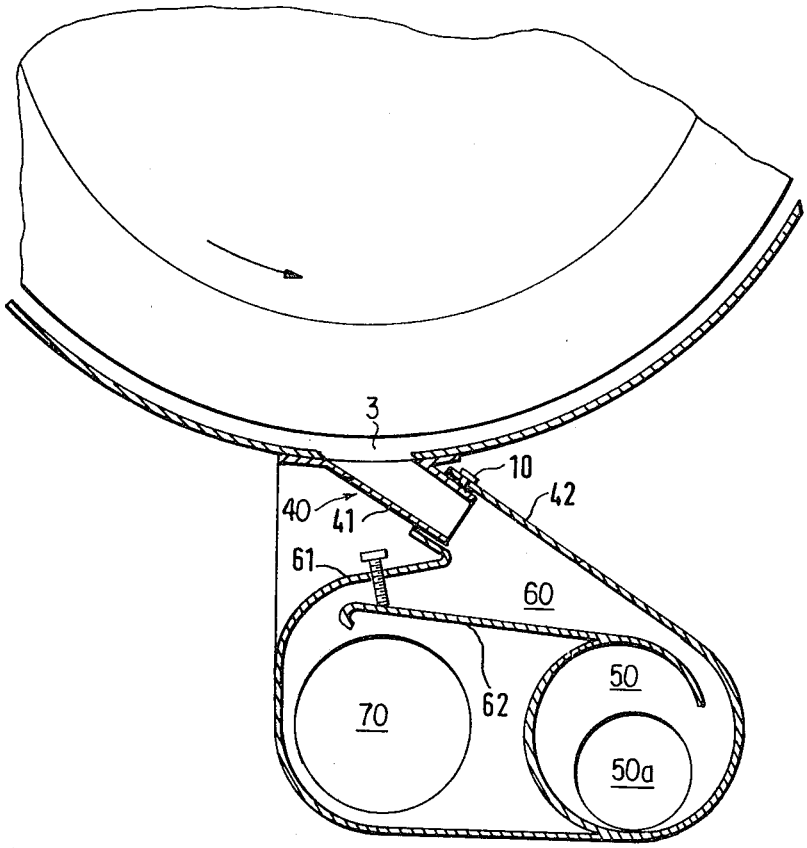
FIG. 2 is a schematic side elevational view of another preferred embodiment of the invention.

Turning now to FIG. 2, there is shown another embodiment of the invention, comprising a length-adjustable braking channel 40. The latter comprises telescoping conduit portions 41 and 42 which may be immobilized with respect to one another by means of an arresting device 10. There is further provided a pressurized air channel 60, whose orientation is variable. For this purpose the pressurized air channel 60 is formed of a wall 61 and an opposite, flexible, movable wall 62, whose orientation may be varied, for example, by a setscrew to adapt it to the exit angle and velocity of the particles. Similarly, to the embodiment according to FIG. 1, the upstream end of the pressurized air channel 60 communicates with a pressure source (not shown) via a conduit 70, while the downstream end of the channel 60 merges into a waste-collecting chamber 50 coupled to a suction conduit 50*a*.

Figure 3:
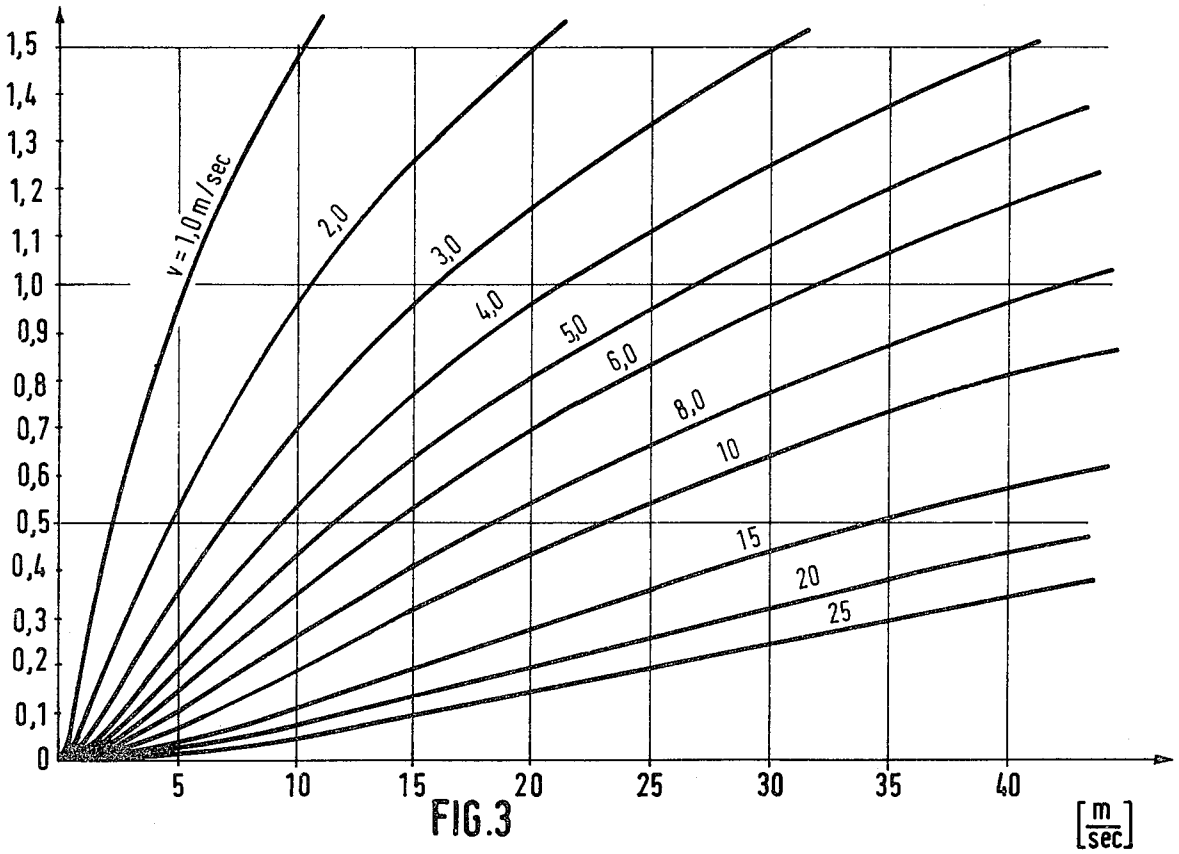
FIG. 3 is a diagram for computing braking paths.

Turning now to FIG. 3, there is illustrated a diagram for calculating the braking path of a particle in an air countercurrent. On the abcissa there are shown the initial velocities of the particles whereas the ordinate indicates the coefficient $N_{crit}$. The velocity of the fluid (such as air) is shown as a parameter.

It will be understood that the above description of the present invention is susceptible to various modifications, changes and adaptations, and the same are intended to be comprehended within the meaning and range of equivalents of the appended claims.

What is claimed is:

1. In a method of separating waste from a fiber-and-waste mixture in a textile machine, including the step of tangentially throwing, in a first zone, the mixture from a rotating roll by the centrifugal force thereof; the improvement comprising the step of directing a gas flow onto the traveling particles of the mixture for impingement therewith in a second zone downstream of said first zone as viewed in the direction of travel of the mixture, for returning the fibers to the roll and allowing the waste particles to continue their travel and removing the waste particles by suction directly from said second zone.

2. A method as defined in claim 1, wherein the gas is directed to the mixture in counterflow.

3. A method as defined in claim 1, wherein the gas is directed to the mixture at an oblique angle to the direction of travel of the mixture.

4. A method as defined in claim 1, wherein the gas is directed to the mixture perpendicularly to the direction of travel of the mixture.

5. In an apparatus for separating fibers from a fiber-and-waste mixture in a textile machine having a rotary roll entraining said mixture; including means for effecting a detachment of the mixture from said roll in a first zone for causing a travel of the mixture tangentially to the roll under the effect of the centrifugal force thereof; the improvement comprising (a) means defining a braking channel having an inlet positioned to receive the mixture traveling from said roll;

(b) air pressure means including a pressurized air channel for directing pressurized air to said inlet of said braking channel for impinging on the mixture in a second zone downstream of said first zone as viewed in the direction of travel of the mixture for decelerating particles of said mixture passing into said braking channel through said inlet, whereby fibers of the mixture are returned to the roll and waste particles of the mixture are allowed to continue their travel in said braking channel;

(c) means defining a waste collecting chamber communicating with an outlet of said braking channel; and (d) suction means communicating with said waste collecting chamber for removing particles therefrom.

6. An apparatus as defined in claim 5, wherein said braking channel has a width; the improvement further comprising means for adjusting said width.

7. An apparatus as defined in claim 6, wherein said means for adjusting said width includes means for arresting said channel in any adjusted width position.

8. An apparatus as defined in claim 5, wherein said braking channel has a length; the improvement further comprising means for adjusting said length.

9. An apparatus as defined in claim 5, wherein said pressurized air channel has a direction of orientation; further wherein said direction of orientation is adjustable.

* * * * *

UNITED STATES PATENT AND TRADEMARK OFFICE

CERTIFICATE OF CORRECTION

PATENT NO. : 4,379,357

DATED : April 12, 1983

INVENTOR(S) : Wolfgang Beneke et al

It is certified that error appears in the above—identified patent and that said Letters Patent is hereby corrected as shown below:

In the heading of the patent, the Assignee under [73] should read: Trützschler GmbH & Co. KG,.

Signed and Sealed this

*Thirteenth* Day of *December 1983*

[SEAL]

*Attest:*

GERALD J. MOSSINGHOFF

*Attesting Officer*

*Commissioner of Patents and Trademarks*